US005516991A

United States Patent [19]

Hommann

[11] Patent Number: 5,516,991

[45] Date of Patent: May 14, 1996

[54] MULTIPLE POSITION MANUAL SWITCH

[75] Inventor: Edgar Hommann, Grossaffoltern, Switzerland

[73] Assignee: Bausch & Lomb Incorporated, Rochester, N.Y.

[21] Appl. No.: 344,032

[22] Filed: Nov. 23, 1994

[30] Foreign Application Priority Data

Nov. 26, 1993 [DE] Germany ..... 43 40 276.3

[51] Int. Cl.[6] ..... H01H 19/00; H01H 21/00; H01H 25/04

[52] U.S. Cl. ..... 200/6 R; 200/5 R; 200/6 B; 200/292; 200/6 A

[58] Field of Search ..... 200/5 R, 5 A, 200/6 A, 52 R, 6 R, 553, 557, 292; 307/115; 15/21.1, 22.1, 23

[56] References Cited

U.S. PATENT DOCUMENTS

| | | | |
|---|---|---|---|
| 2,808,476 | 10/1957 | Elliott | 200/6 A |
| 2,849,548 | 8/1958 | Young | 200/6 A |
| 3,005,055 | 10/1961 | Mattke | 341/184 |
| 3,529,109 | 9/1970 | Cross | 200/557 |
| 3,691,324 | 9/1972 | Brantingson | 200/5 E |
| 3,852,557 | 12/1974 | Brown | 200/241 |
| 3,996,427 | 12/1976 | Kaminski | 200/5 A |
| 3,996,429 | 12/1976 | Chu et al. | 200/5 A |
| 4,018,999 | 4/1977 | Robinson et al. | 200/5 A |
| 4,029,915 | 6/1977 | Ojima | 200/5 A |
| 4,124,787 | 11/1978 | Aamoth et al. | 200/6 A |
| 4,160,138 | 7/1979 | Brown | 200/437 |
| 4,246,452 | 1/1981 | Chandler | 200/5 A |
| 4,256,931 | 3/1981 | Palisek | 200/5 A |
| 4,267,412 | 5/1981 | Janssen et al. | 200/6 B |
| 4,341,383 | 7/1982 | Reichert | 273/85 G |
| 4,355,483 | 10/1982 | Korzelius | 446/484 |
| 4,395,134 | 7/1983 | Luce | 368/3 |
| 4,400,597 | 8/1983 | Bruder et al. | 200/6 B |
| 4,408,103 | 10/1983 | Smith, III | 200/6 A |
| 4,428,649 | 1/1984 | Main et al. | 350/289 |
| 4,430,578 | 2/1984 | Waigand | 307/115 |
| 4,439,648 | 3/1984 | Reiner et al. | 200/6 A |
| 4,454,396 | 6/1984 | Neese | 200/292 |
| 4,465,908 | 8/1984 | Griffith et al. | 200/5 R |
| 4,479,516 | 10/1984 | Hunter | 132/84 R |
| 4,486,629 | 12/1984 | Sledesky | 200/6 A |
| 4,490,587 | 12/1984 | Miller et al. | 200/5 A |
| 4,501,939 | 2/1985 | Hyltin et al. | 200/6 A |
| 4,544,816 | 10/1985 | Benz | 200/52 R |
| 4,595,850 | 6/1986 | Woog | 335/207 X |
| 4,614,847 | 9/1986 | Sasao | 200/6 A |
| 4,687,200 | 8/1987 | Shirai | 273/438 |
| 4,795,862 | 1/1989 | Linden | 200/6 A |
| 4,796,323 | 1/1989 | Benz | 15/23 |
| 4,845,796 | 7/1989 | Mosley | 15/23 |
| 4,882,801 | 11/1989 | Benz | 15/23 |
| 4,904,833 | 2/1990 | Sato et al. | 200/557 |
| 4,920,238 | 4/1990 | Aso | 200/6 R |
| 5,086,313 | 2/1992 | Misawa | 200/5 R |
| 5,283,401 | 2/1994 | Schmucker | 200/6 A |

FOREIGN PATENT DOCUMENTS

| | | | |
|---|---|---|---|
| 1226605 | 9/1987 | Canada | 306/303 |
| 0123184 | 10/1984 | European Pat. Off. | H01H 13/70 |
| 1427082 | 12/1965 | France | H01H 13/12 |

*Primary Examiner*—J. R. Scott
*Attorney, Agent, or Firm*—Katherine McGuire; Denis A. Polyn

[57] ABSTRACT

A manual switch (2) has a switching plate (9), which can be tilted to several sides and is mounted on a mounting (10). This switching plate (9) can move with star-shaped actuating arms that correspond to the contact arms of a contact spring (7) in the direction of a printed circuit board (6), so that it can close a circuit by means releasably, lockingly engaging the selected actuating arm against a respective contact arm and an electric contact on the printed circuit board. At any switch position one can switch back directly into the zero position by pressing an adjusting arm (13) which moves the switching plate (9) back into its non-tilted position.

8 Claims, 5 Drawing Sheets

MULTIPLE POSITION MANUAL SWITCH

BACKGROUND OF THE INVENTION

The invention relates to a multi staged manual switch to selectively close several electrical connections and to interrupt the switched connections, in particular for an electric toothbrush in order to switch on and off different output stages of a toothbrush motor.

Manual switches of the aforementioned kind are employed in numerous electric devices and are known and useful in very different designs. In the case of an electric toothbrush for example, one can switch on different motor speeds with such a manual switch. In the case of a hair dryer correspondingly different heating stages can be selected.

To date such manual switches have been designed as multi stages rotary switches for smaller electric devices used by consumers, for example, for electric toothbrushes or hair dryers. In such rotary switches the sequence of the switching operation is automatically fixed. From the zero positions one can switch only into the first and thereafter into the respective other switch position. Even when switching the device off, one has to switch back again from a higher switching stage through all of the lower switching stages, in order to reach the zero position. This manipulation is perceived frequently as tedious.

Of course, it is also known in the state of the art to arrange several pressure contact switches side-by-side in order to switch on several output stages. Then the interrupter has to be coupled to the individual pressure contact switches of the different output stages, so that, when the interrupter is depressed, all of the pressure contact switches are switched back into their zero position. Pressure contact switches with such features are, however, quite expensive so that to date they are not common in smaller, inexpensive devices for consumer use on account of the cost.

The invention is based on the problem of designing a multi staged manual switch of the aforementioned kind that is constructed as simply as possible so that its switching stages and also its zero position can be switched in any arbitrary sequence.

SUMMARY OF THE INVENTION

This problem is solved according to the invention in that the manual switch has a contact spring, which is to be connected to an electric pole and has several star-shaped radially extending contact arms in accordance with the number of switching stages. A switching plate is pivotally mounted on a central mounting above the contact spring in order to depress and move against a fixed contact of any arbitrary contact arm. The switching plate is provided with star-shaped rapidly extending actuating arms, which correspond to and extend over the contact arms of the contact spring.

With such a multi staged manual switch one can activate different switch positions by tilting the switching plate in different directions. Therefore, only one simple manual switch with only one actuator, namely the switching plate, is required to switch between several switching stages. Since the manual switch according to the invention has only one single switching plate, the zero position can be reached by moving the switching plate back into its non-tilted position out of any switch position by means of a single movement of the switching plate, so that in the case of rotary switches one can dispense with the tedious switching through different switching stages when one wants to reach the zero position from a higher switching stage.

The multi staged manual switch according to the invention can be a push button, which remains in the respective switch position against the force of the contact spring only until an actuating force is exerted on its switching plate, thus for example, until one presses with a finger on its switching plate or on a component that is connected to said switching plate. However, according to an advantageous embodiment of the invention the manual switch can also be designed as a set switch, if a click-stop device is assigned to each actuating arm, in order to fix force-lockingly the actuating arm in its tilted position holding the respective contact arm against a fixed contact.

To reset the switching plate into its non-tilted normal position, in which the manual switch is situated in its zero position, there are clearly perceivable setting paths, if, according to another embodiment of the invention, the switching plate has a return lever in order to move said switching plate out of a tilted, locked position into a non-tilted position causing the manual switch to open.

For every switching of an output stage of the manual switch the return lever swivels in the same direction transversely to the plane of the printed circuit board, if said return lever is pivot-mounted on one side of the switching plate and rests on the side of the switching plate opposite the contact spring. With such a design it is possible to move the return lever back into its normal position by depressing a reset key and thus to reach the zero position of the manual switch from any switch position merely by pressing the reset key.

The switching plate could be operated directly for switching. For application in small, electric devices, however, it is expedient, if there are moveable keying bodies in order to actuate the actuating arms of the switching plate and the return lever against the spring force in the direction of the actuating arms and the return lever.

The zero position of the manual switch can also be switched indirectly, if, according to another embodiment of the invention, the return lever has on the side opposite its swivelable bearing an adjusting arm, which projects beyond the switching plate and against which the related keying body rests.

The manual switch according to the invention can be arranged in a simple manner sealingly in a housing, if the keying bodies are formed by means of projections of an electric switch cap covering the manual switch.

The design of the mounting, which enables the tilting of the switching plate, can vary widely. For example, it can be a ball socket with which the switching plate with a ball end engages. The manual switch is designed in an especially simple manner if the mounting exhibits a bearing region with outwardly descending bearing surfaces, if the switching plate is held on this bearing region by an axle penetrating the contact spring and the switching plate and if the axle has on the side of the switching plate opposite the contact spring at a distance from the switching plate a head forming an abutment for the switching plate.

The locking of the actuating arms into the respective switch position results in a very low cost for constructing the manual switch, if the switching plate hold for each actuating arm of the switching plate has two elastic guide arms, which extend on the side along the respective actuating arm and which exhibit as the click-stop device a stop projection directed in the direction of the respective actuating arm.

The construction of the manual switch can be simplified even more if the contact spring is mounted directly on a conducting track of a printed circuit board and its contact arms are designed for making contact with other conducting tracks of the printed circuit board.

The assembly of the manual switch does not involve a great deal of complexity, if, according to another embodiment of the invention, the switching plate holder grasps with an extension through a passage of the contact spring and is fixed in an opening of the printed circuit board.

The invention allows numerous embodiments. To further elucidate the basic principle one of them is depicted in the drawings and is described in the following.

DETAILED DESCRIPTION

Figure 1:
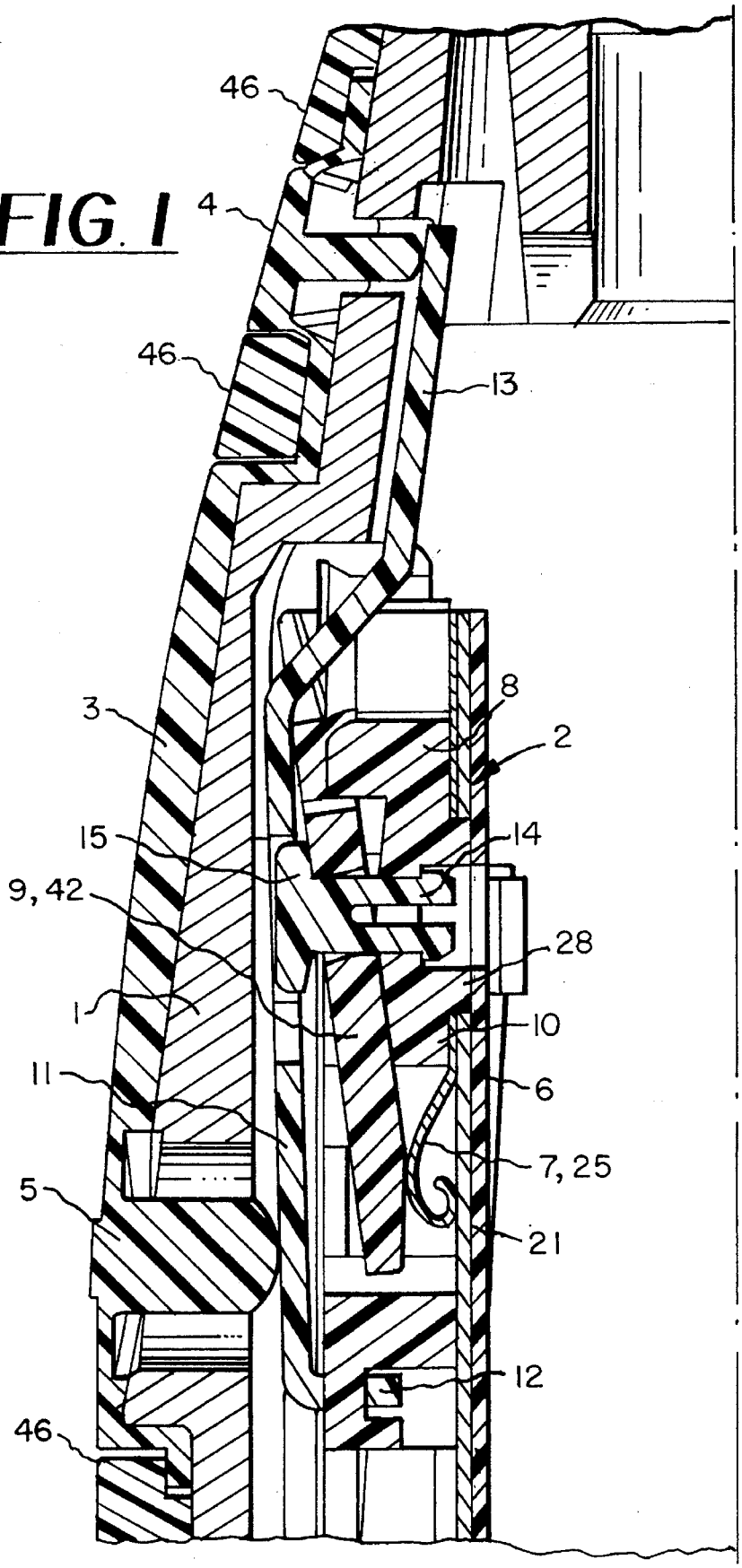
FIG. 1 is a longitudinal view of a fragment of an electric toothbrush with the manual switch according to the invention.

FIG. 1 shows a subregion of a housing 1 of an electric toothbrush, into which is installed a manual switch 2. To operate this manual switch 2, the housing 1 has an elastic switching cap 3, which has keying bodies 4 and 5, projecting into the housing 1 and which is fixedly secured to the housing 1 by a rigid retaining plate 46 having openings wherethrough the switching cap 3 extends. In addition to these keying bodies, this embodiment also has two other keying bodies, which cannot be seen, however, in FIG. 1. If the keying body 4 is depressed, the manual switch 2 switches back into its zero position. If the keying body 5 or one of the two other keying bodies (not visible) is depressed, a specific output stage of the toothbrush is switched on.

Inside the housing 1, the manual switch 2 has a printed circuit board 6, on which is mounted a contact spring 7, is held by means of a switching plate housing 8. This switching plate housing 8 braces a switching plate 9, which rests tiltably on a mounting 10. The individual switch positions of the manual switch 2 result from varying tilted positions of the switching plate 9, wherein the tilting is caused by pressing the keying body 5 and the other keying bodies (not illustrated). Above the switching plate 9 is a return lever 11, which can be pivoted on one side of the switching plate housing 8 by means of a bend 12, which leads away over the switching plate 9 on the side opposite the contact spring 7, and has on the side opposite its swivelable bearing an adjusting arm 13, against which the keying body 4 rests. If the keying body 4 is depressed, then the adjusting arm 13 is moved to the right, as shown in FIG. 1. Then the return lever 11 presses the upper end of the switching plate 9 to the right, resulting in the bottom end of the switching plate 9 swiveling to the left and thus assuming its zero position extending parallel to the printed circuit board 6.

FIG. 1 also depicts an axle 14, which penetrates the switching plate 9, is locked with its right end, as shown in FIG. 1, in the switching plate housing 8 and has on the opposite side a head 15 reaching over the switching plate 9.

Figure 2:
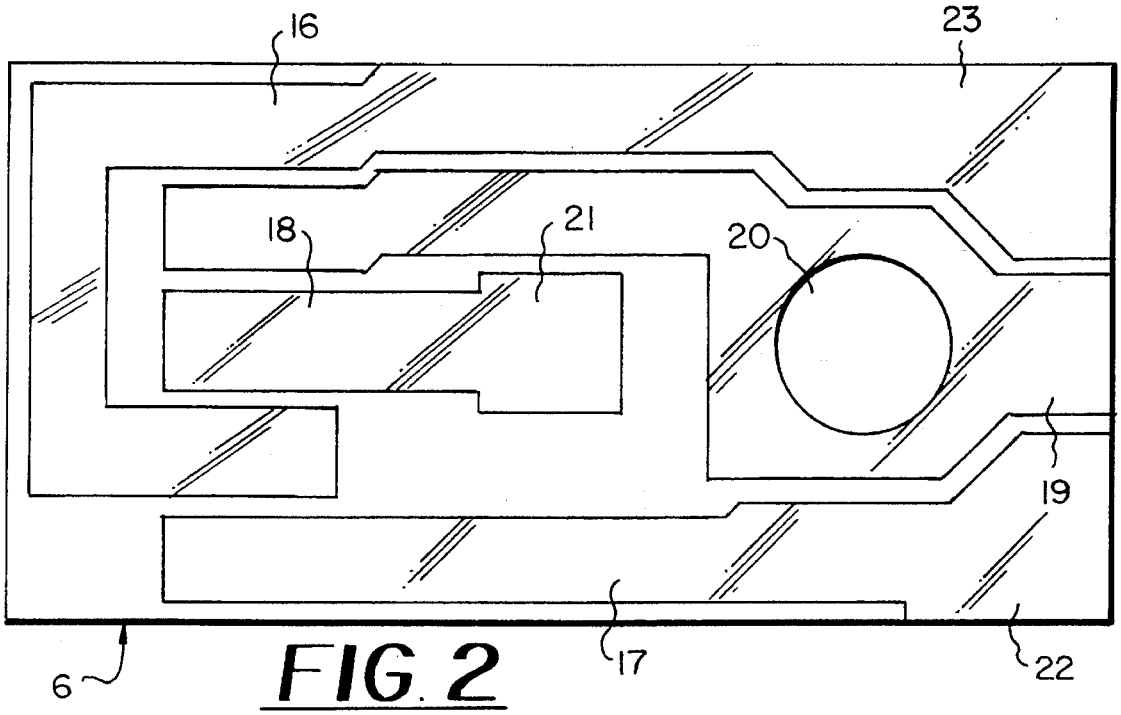
FIG. 2 is a top view of a printed circuit board of the manual switch.

The top view of the printed circuit board 6 depicted in FIG. 2 shows that said printed circuit board has conducting tracks 16, 17, 18, 19. The conducting tracks 16, 17, 18 have, at a distance from a circular opening 20 in the printed circuit board 6, a fixed contact 21, 22, 23, formed by a surface expansion.

Figure 3:
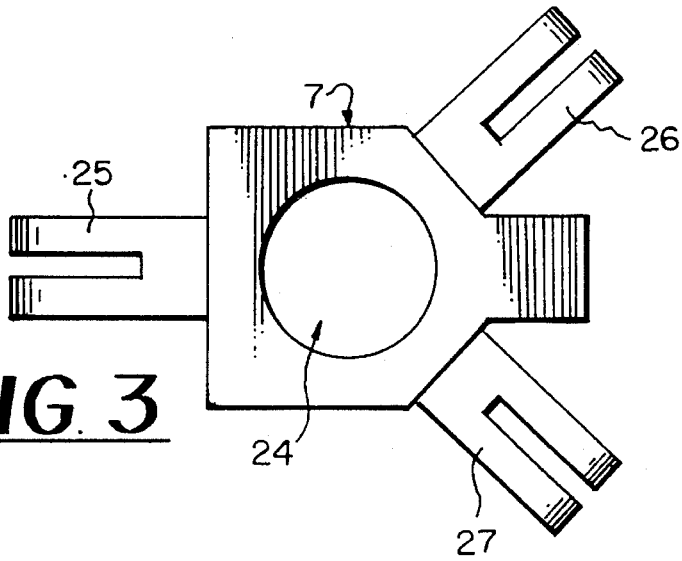
FIG. 3 is top view of a contact spring of the manual switch.
Figure 4:
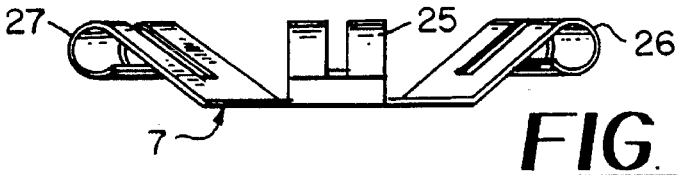
FIG. 4 is a side view of the contact spring.

The top view of the contact spring 7 depicted in FIG. 3 shows that said contact spring has a passage 24 corresponding to the opening 20 in the printed circuit board 6. Furthermore, said spring exhibits three contact arms 25, 26, 27, which point diagonally to the top as shown in FIG. 4. This contact spring 7 is mounted in such a manner on the conducting track 19 of the printed circuit board 6 that its passage 24 aligns with the opening 20. Depending on to which side the switching plate 9, shown in FIG. 1, is tilted, it pushes one of the contact arms 25, 26, 27 against one of the fixed contacts 21, 22, 23 of the printed circuit board 6; respectively.

Figure 5:
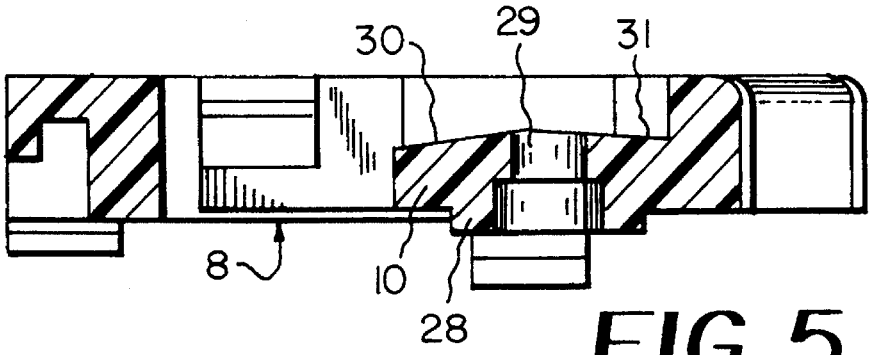
FIG. 5 is a sectional view of a switching plate holder of the manual switch.
Figure 6:
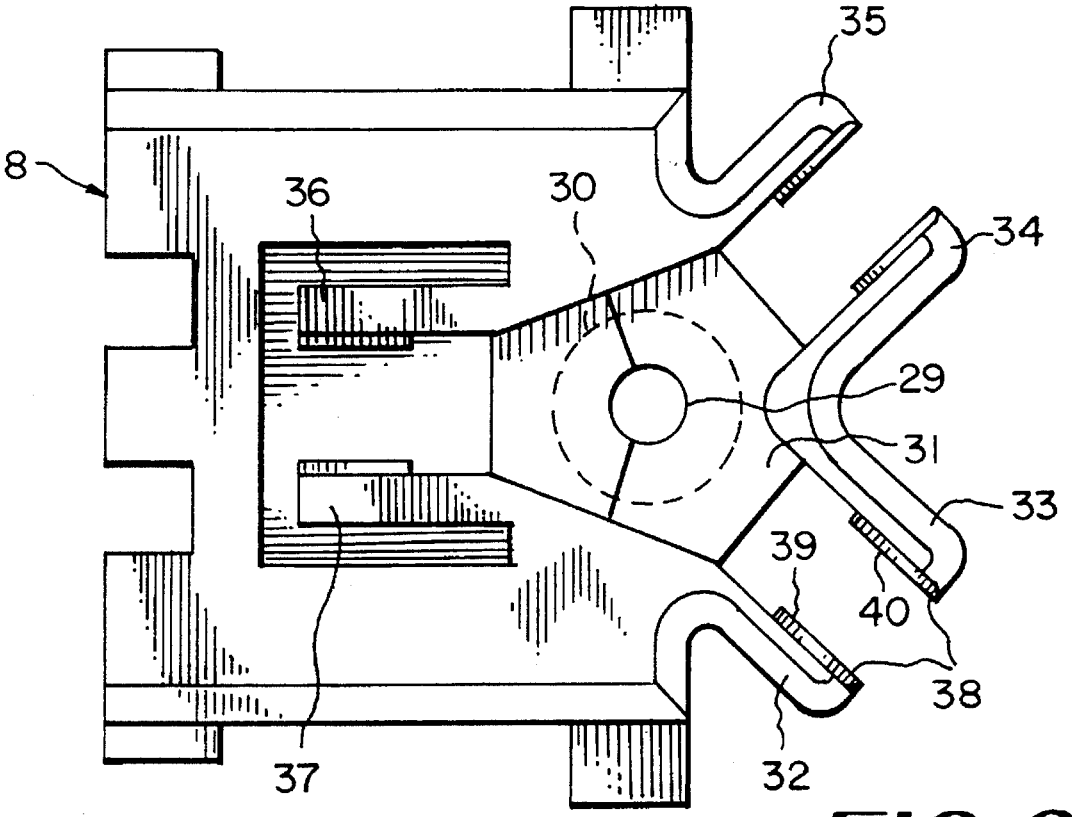
FIG. 6 is a top view of the switching plate holder.

FIGS. 5 and 6 show the shape of the switching plate housing 8. It is apparent from FIG. 5 that said housing has an extension 28 which protrudes at the bottom as shown in FIG. 5 and which fits exactly through the passage 24 of the contact spring 7 and through the opening 20 of the printed circuit board 6 and can, thus, fix the contact spring 7 on the printed circuit board 6, a feature that is also evident from FIG. 1. Furthermore, FIG. 5 shows clearly that the mounting 10 on both sides of the bore hole 29, into which is installed the axle 14, shown in FIG. 1, has a bearing surface 30, 31, which descends outwardly as seen starting from the bore hold 29. The switching plate 9 rests in its tilted position against one of these bearing surfaces 30, 31.

FIG. 6 shows that the switching plate housing 8 has three pairs of elastic guide arms 32, 33; 34, 35; 36, 37 that are outwardly directed in the shape of a star when viewed starting from the bore hole 29. The free cross section between the respective guide arms 32–37 is constricted in the vicinity of their respective free end by means of a click-stop device 38, which consists of a stop projection 39, 40, which projects into the space between the guide arms 32–37.

Figure 7:
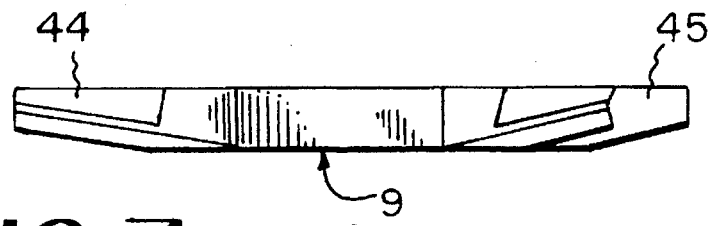
FIG. 7 is a side view of a switching plate of the manual switch.
Figure 8:
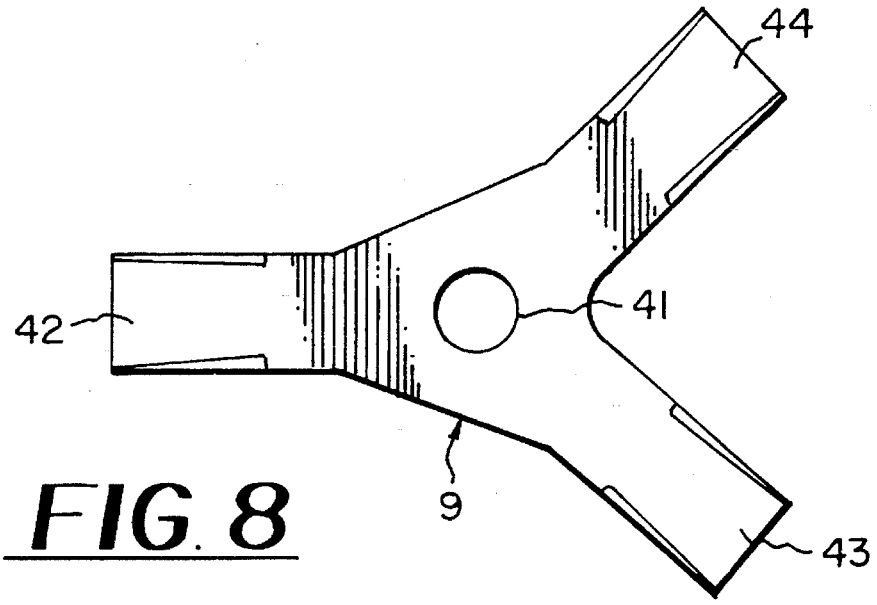
FIG. 8 is a top view of the switching plate.

The exact shape of the switching plate 9 can be seen in FIGS. 7 and 8. Said switching plate has a central bore hole 41, from which three actuating arms 42, 43, 44 lead outwardly in the shape of rays. Said arms are dimensioned in such a manner that they are situated between the pairs of guide arms 32, 33; 34, 35 and 36, 37 above the respective click-stop device 38 when the switching plate 9 installed in the switching plate housing 8 is not tilted. The keying body 5 shown in FIG. 1 and the two other keying bodies (not visible) for actuating the switching plate 9 are arranged in such a manner that each keying body 5 can push down one of the actuating arms 42, 43, 44. Said keying body can then push the corresponding contact arm 25, 26, 27 of the contact spring 7, shown in FIG. 3, against the corresponding fixed contact 21, 22, 23 of the printed circuit board 6, shown in FIG. 2, so that the corresponding switching stage of the manual switch 2 is switched.

Figure 9:
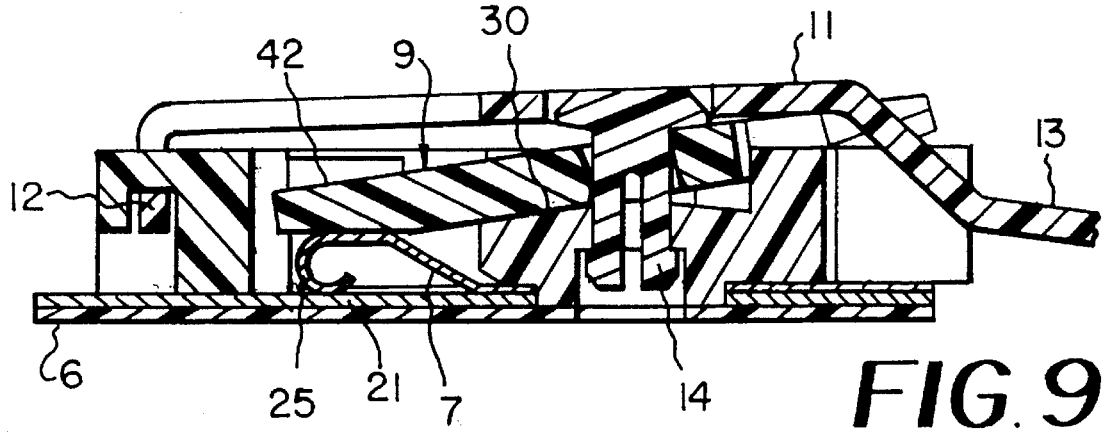
FIG. 9 is a longitudinal view of the manual switch in a first switch position.

When the switching plate 9 is in the position shown in FIG. 9, said switching plate is swivelled with its actuating arm 42 in the direction of the printed circuit board 6, so that said plate presses the contact arm 25 of the contact spring 7 against the fixed contact 21, thus switching a first switching stage. In this position, the switching plate 9 lies on the bearing surface 30. At the same time said switching plate has swung the return lever 11 slightly counter-clockwise around a swivelable attachment, attached by means of the bend 12.

Figure 10:
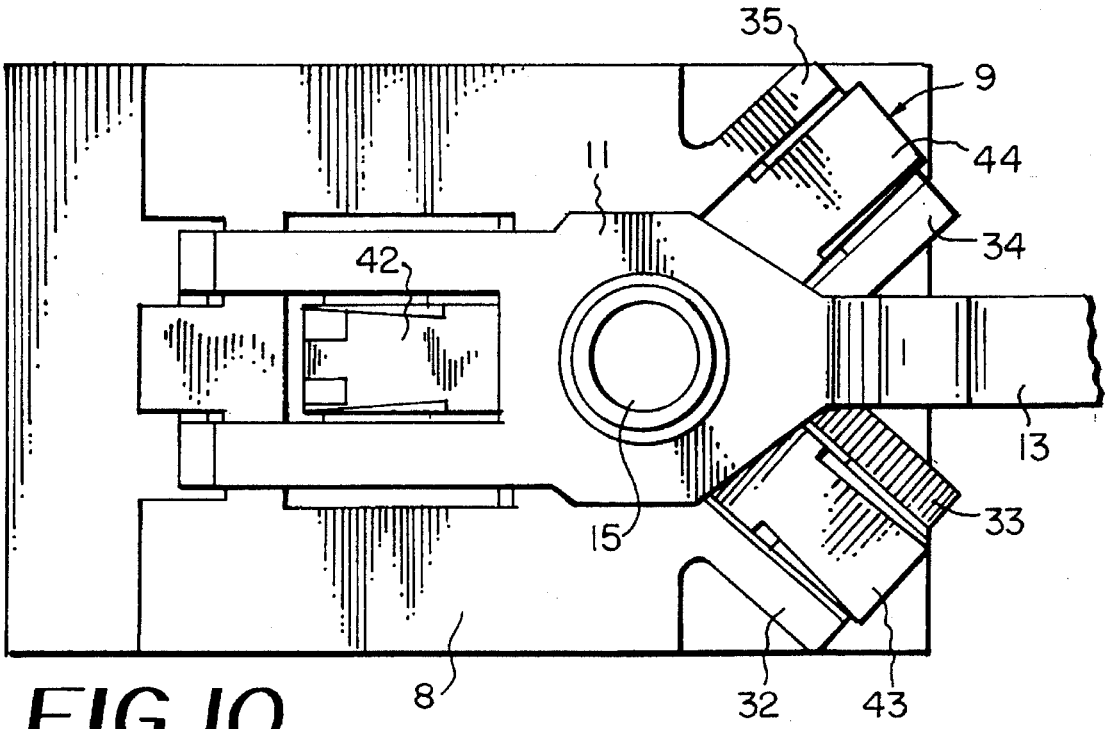
FIG. 10 is a top view of the manual switch.

The top view according to FIG. 10 shows below the return lever 11 the switching plate 9 with its actuating arms 42, 43, 44. Furthermore, the switching plate housing 8 can be seen that guides these actuating arms 42, 43, 44 with the guide arms 32, 33, 34, 35, which can be seen in FIG. 10, and the guide arms 36, 37, which can also be seen in FIG. 6.

Figure 11:
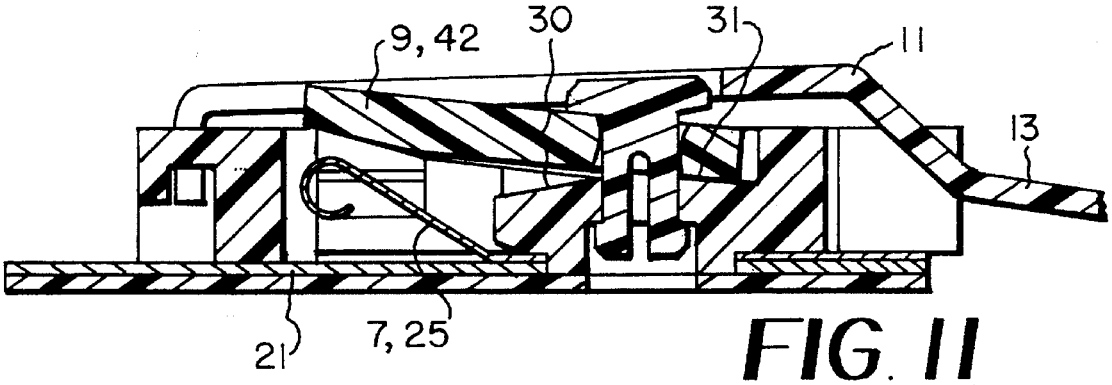
FIG. 11 is a longitudinal view of the manual switch in a second switch position.

In FIG. 11 the switching plate 9 is swung in the opposite direction to the position according to FIG. 9 by pressing on the actuating arm 43 or 44. Then, instead of bracing against the bearing surface 30, it braces in part on the bearing surface 31. Depending on whether it is also swung to the front or the rear, whether the actuating arm 43 or 44 was pushed down, the contact arm 26 or 27 makes contact with the fixed contact 22 or 23, so that either a second or third switching stage is switched. In these positions the return lever 11 was in turn lifted slightly.

Figure 12:
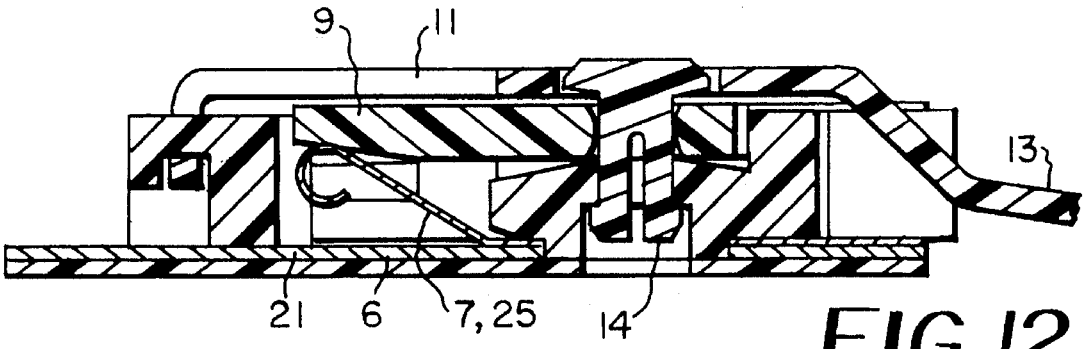
FIG. 12 is a longitudinal view of the manual switch in the zero position.

If the adjusting arm 13 of the return lever 11 is depressed in the position of the return lever 11, shown in FIGS. 9 and 11, by depressing the keying body 4, said adjusting arm pushes the switching plate 9 back into a position parallel to the printed circuit board 6, a feature that is shown in FIG. 12 and in which none of the fixed contacts 21, 22, 23 are contacted. Thus, it is possible to switch into the zero position from any switch position by depressing the keying body 4.

List of Reference Numerals

| | | | |
|---|---|---|---|
| 1 | housing | 26 | contact arm |
| 2 | manual switch | 27 | contact arm |
| 3 | switching cap | 28 | extension |
| 4 | keying body | 29 | bore hole |
| 5 | keying body | 30 | bearing surface |
| 6 | printed circuit board | 31 | bearing surface |
| 7 | contact spring | 32 | guide arm |
| 8 | switching plate housing | 33 | guide arm |
| 9 | switching plate | 34 | guide arm |
| 10 | mounting | 35 | guide arm |
| 11 | return lever | 36 | guide arm |
| 12 | bend | 37 | guide arm |
| 13 | adjusting arm | 38 | click-stop device |
| 14 | axle | 39 | stop projection |
| 15 | head | 40 | stop projection |
| 16 | conducting track | 41 | bore hole |
| 17 | conducting track | 42 | actuating arm |
| 18 | conducting track | 43 | actuating arm |
| 19 | conducting track | 44 | actuating arm |
| 20 | opening | | |
| 21 | fixed contact | | |
| 22 | fixed contact | | |
| 23 | fixed contact | | |
| 24 | passage | | |
| 25 | contact arm | | |

I claim:

1. A multi-stage manual switch for use in an electric circuit, said switch enabling selection between individual output stages of a multi-stage electric motor connected to said circuit, said multi-stage switch comprising:

a) a contact spring having at least three radially extending contact arms each normally biased in spaced relation adjacent a respective stationary electric contact of said circuit, each of said electric contact and contact arm pair, when engaged, completing a path in said circuit which activates a different one of said output stages of said motor;

b) a switching plate having at least three radially extending actuating arms positioned adjacent said at least three contact arms, respectively, opposite said electric contacts;

c) a post extending perpendicularly from the center of said contact spring, said switching plate being pivotally mounted to said post; and d) switch engagement means for releasably and lockingly engaging a selected one of said contact arm and actuating arm pairs upon manually pressing the actuating arm against the associated contact arm of said selected pair whereupon said associated contact arm is brought into engagement with a respective said electric contact, thereby actuating a selected one of said output stages.

2. The multi-stage manual switch of claim 1 wherein said releasable engagement means comprises a switching plate housing having at least three radially extending pairs of spaced guide arms between which a respective actuating arm of said switching plate extends, said guide arms each having a resilient projection extending in the direction of the other one of said guide arm of a said guide arm pair, whereby opposite sides of said actuating arm may be pivotally forced past said resilient projections of a respective guide arm pair to releasably engage a respective said contact arm which, in turn, is forced against a respective said electric contact to actuate said selected one of said output stages, said resilient projections acting to prevent movement of said engaged actuating arm in a direction away from said engaged contact arm until said engaged actuating arm is moved in said direction with a force sufficient to pass said resilient projections.

3. The multi-stage manual switch of claim 2 wherein the pivotal mounting of said switching plate causes an engaged actuating arm to move in said direction from a respective said contact arm, and pass said resilient projections, and thereby disengaging said engaged actuating arm upon manually pressing a different one of said actuating arms.

4. The multi-stage manual switch of claim 2 wherein said switching housing is mounted to said post between said contact spring and said switching plate.

5. The multi-stage manual switch of claim 1, and further comprising a return lever pivotally mounted to said post on the side of said switching plate opposite said contact spring, said return lever having a bearing surface adjacent said post and first and second, opposite ends spaced from said post, whereby manually pressing said first end causes said bearing surface to be pressed against the portion of said switching plate located adjacent said post, said return lever thereby pivoting said switching plate to a position where none of said actuating arms is engaged with a respective said contact arm, and said motor thereby being rendered inactive.

6. The multi-stage manual switch of claim 5, and further comprising a plurality of elastic keying bodies positioned in covering relation over respective ones of each of said actuating arms and said return lever first end, said keying bodies each having an exposed surface against which a user may press with a finger to operate said switch by bringing said keying body into contact with a respect one of said actuating arms and return lever first end.

7. The multi-stage manual switch of claim 2 wherein said projections are elongated flanges extending parallel to one another on each guide arm pair and parallel to a respective said actuating arm.

8. The multi-stage manual switch of claim 1 wherein said contact spring is mounted on a first conducting track of a printed circuit board and said stationary electric contacts comprise second, third and fourth conducting tracks of said printed circuit board.

* * * * *